United States Patent [19]

Kollmeder

[11] 3,968,345

[45] July 6, 1976

[54] COMBINED WAX AND EDGE SHARPENING APPARATUS FOR SKIERS

[76] Inventor: Michael Kollmeder, Gorzerstr. 5, 8 Munich 80, Germany

[22] Filed: Sept. 4, 1974

[21] Appl. No.: 503,526

[30] Foreign Application Priority Data

Sept. 17, 1973 Germany ..... 2346717

[52] U.S. Cl. ..... 219/228; 29/80; 30/140; 219/421; 219/473; 219/533; 280/11.37 T; 401/1

[51] Int. Cl.² ..... A63C 11/04; H05B 1/00

[58] Field of Search ..... 219/221, 227–228, 219/230, 231, 236, 241, 242, 243, 421, 533, 472–474; 280/11.37 R, 11.37 T; 29/78, 80; 30/140; 401/1, 2

[56] References Cited

UNITED STATES PATENTS

| | | | |
|---|---|---|---|
| 1,394,662 | 10/1921 | Blomquist | 219/228 UX |
| 1,400,784 | 12/1921 | Archer | 219/230 |
| 2,249,600 | 7/1941 | Bryan | 219/240 X |
| 2,851,712 | 9/1958 | Howard | 280/11.37 T |
| 2,887,711 | 5/1959 | Hutchinson | 219/227 UX |
| 3,391,946 | 7/1968 | Luff | 280/11.37 T |
| 3,711,678 | 2/1971 | Kuus | 219/236 X |

FOREIGN PATENTS OR APPLICATIONS

| | | | |
|---|---|---|---|
| 42,413 | 7/1970 | Finland | 401/1 |
| 638,570 | 11/1936 | Germany | 280/11.37 T |
| 960,164 | 3/1957 | Germany | 401/1 |
| 179,792 | 3/1936 | Switzerland | 280/11.37 T |
| 185,445 | 10/1936 | Switzerland | 219/242 |
| 86,396 | 7/1920 | Switzerland | 401/1 |

*Primary Examiner*—A. Bartis
*Attorney, Agent, or Firm*—Cushman, Darby & Cushman

[57] ABSTRACT

A combination waxing device and edge sharpener for skis having a combined file guide and waxing surface; the file being adjustably securable to a lateral side substantially perpendicular to the guide surface. A wax container is provided on the opposite side of the device from the guide and waxing surface and channels are provided through which the melted wax is delivered to the waxing surface to be applied to the skis. Two means of heating the device are provided to melt the wax placed in the container; one is an alcohol burner of predetermined proportions which heats the device through at least one flue extending through the device adjacent the wax container, and the second means of heating is an electric heating rod which may be placed within the flue so as to provide continuous heat to the device for extended use.

16 Claims, 5 Drawing Figures

COMBINED WAX AND EDGE SHARPENING APPARATUS FOR SKIERS

The invention relates to a combined waxing device and edge sharpener for skiers with a file holder carrying at least one metal file, which holder has a guide surface standing perpendicularly to the cut of the metal file and in which the metal file can be clamped down with a variable position in relation to the longitudinal and transverse direction of the file.

An edge sharpening tool (Swiss Patent No. 499,336) (Winter catalogue 72/73, Sport-Muenzinger, Munich) for sharpening of the steel edges of skis has been known, in which a metal file is screwed on a projection running perpendicularly to a guide surface, which file can be guided with a guide surface resting on the running surface of the ski along its steel edge, in order to scrape it and thus to sharpen it with said metal file. This edge sharpener made of plastic has the disadvantage that the metal files attached to the projection can only be slightly adjusted in their position in relation to the guide surface and that they are very narrow. Therefore they are used up and blunted quickly. The metal file also has only one cut on one side, so that correspondingly the metal files must be replaced frequently.

Another edge sharpening tool (Germ. Utility Patent No. 69 10927) has also been known, in which the metal file can be clamped down in a slit of the file handle in variable position. In this edge sharpener the surface of the cut of the metal file can be utilized to a larger extent since the metal file can be clamped down in the file handle in any random position.

Beside the care for the sharpness of the edge, the preparation of the running surface of the ski by waxing it is of importance for the ski sport. There is a large number of waxing tools, with which liquid wax can be applied to the running surface. Particularly, it has been known to apply the liquid wax either with an endless belt passing through the wax bath or to apply it with a brush. These implements however can only be used stationary. In order to make it possible for the skier to wax his skis also independently of such stationary implements, hand waxing tools heatable with dry alcohol (spirits) or gas have been known (Swiss Patent No. 179,792) (Winter catalogue 72/73, Sport-Muenzinger, Munich). These waxing devices are very unwieldy, so that the skier has difficulty to carry them with him.

Whenever the skier wishes to carry along a waxing device as well as an edge sharpener, using the available implements this becomes even more troublesome, since two different implements must be taken along. This will be particularly troublesome whenever the skier does not want to carry along a rucksack or a ski-bag and must find a place for these two implements in the pockets of his clothes.

The invention is based on the task of creating a combined waxing device and edge sharpener for skiers, which is very handy and which can easily be carried in the pocket of a piece of clothing. Particularly however, the waxing device and edge sharpener is to take care during the waxing of the skis on the basis of the manner of the application of the wax, that the layer of wax be applicable evenly with a smooth surface over the entire length of the ski. The device is to be heatable both by dry spirits as well as electrically, whereby the use of dry spirits is to be provided mainly for the outside and for one time use and the use of the electric heating for the domestic area and for repeated use.

In case of use of dry alcohol care is to be taken furthermore that any overheating of the waxing implement be avoided so that the ski wax can not catch fire. This waxing implement is to be combined with an edge sharpener, which offers the possibility of clamping down a metal file in variable positions so that the file can be worn out and used up evenly over its entire cut.

Starting out from the initially mentioned file holder, this task is solved according to the invention in that the file holder is developed as a heatable and flat waxing device and that said waxing device has a wax container from which the melted wax flows right through the waxing device to the guide and wax distribution surface and is distributed evenly over the running surface of the ski as the combined implement is pulled along.

Such a combined waxing device and edge sharpener produced according to the characteristics of the invention offers the considerable advantage that the flow of the liquid wax from the wax containers through the waxing device to the guide and wax distribution surface and the spreading during distribution on the running surface of the ski below the guide and distribution surface takes place at an essentially unvarying temperature. Thus the wax is maintained in its liquid state until it is detached during the pulling along of the waxing device on the running surface of the ski at the rear break or the rear edge of the guide and wax distribution surface in a still liquid state. This results in a very evenly thick layer of wax developed with a closed smooth surface on the entire running surface of the ski. Furthermore, the implement of the invention offers the advantage that it can be accommodated as a flat handy implement in a parka pocket and can be used any time during skiing on the way, both for sharpening of edges as well as for waxing of skis. Because of the possibility of jamming of the metal file in variable longitudinal and transverse positions, whereby said metal file can also be jammed in relation to the longitudinal axis of the file at an angle to the longitudinal dimension of the file handle in the slit like recess, it will be possible to clamp down the preferably single cut metal file always in such a way that still sharp teeth of the file lie in that range, which is guided along the steel edge of the ski. Since the guide and wax distribution surface of the ski is developed level and with a relatively large surface, a very good guidance results during edge sharpening, so that a round grinding of the edges will be avoided, as is unavoidable in case of known edge sharpeners with relatively narrow support and adjustable metal file. The disadvantage of round grinding of the edges also results in case of edge sharpeners, in case of which the metal file is attached fixedly to the attachment running at right angles to the guide surface, whenever said file starts getting blunt.

Whenever the combined device is to be used as a waxing device, it is placed on the front surface of the rectangular body adjacent to the closeable hollow space. A cake of dry alcohol is inserted into the hollow space and is lit, whereby the rising combustion gasses rise through the flue bores in the rectangular body and heat said body. Whenever the latter after burning of the dry alcohol has reached the temperature needed for melting of the wax, the rectangular body resting with the guide and wax distributing surface on the running surface of the ski is moved over the latter, whereby the wax inserted in the wax container melts and is distributed through the multiplicity of bores on the running surface of the ski. At the same time, for the purpose of waxing of the ski, the metal file is removed from the slit like recess.

In order to make sure, that the wax emerging through the multiplicity of the bores in the guide and distribution surface would be distributed over the running surface of the ski as evenly as possible, provision has been made according to the invention that the mouths of the multiplicity of bores would be enlarged in the shape of a hemisphere in the guide and wax distributing surface. Thus, an even, thin application of the film of wax on the running surface of the ski will be ensured.

In order to be able to avoid any reheating of the waxing device in buildings etc., or in order that a large number of skiers could wax their skis in succession, provision has been made in the invention, that an electric heating rod can be inserted into at least one flue bore. With this heating rod the rectangular body is heated to the temperature needed for melting of the wax and is kept at it during the entire waxing process.

It can be desirable, that during sharpening of the edges, the outside surface of the edge is slightly inclined at a slight angle to the running surface of the ski. This can be particularly desirable for very icy starts. Therefore, according to another development of the invention provision has been made that the slit shaped recess for the accommodations of the metal file runs inclined at a slight angle toward the guide and wax distributing surface.

The advantages and characteristics of the invention are also shown in the subsequent description of an embodiment in connection with the claims and the drawing.

Figure 1:
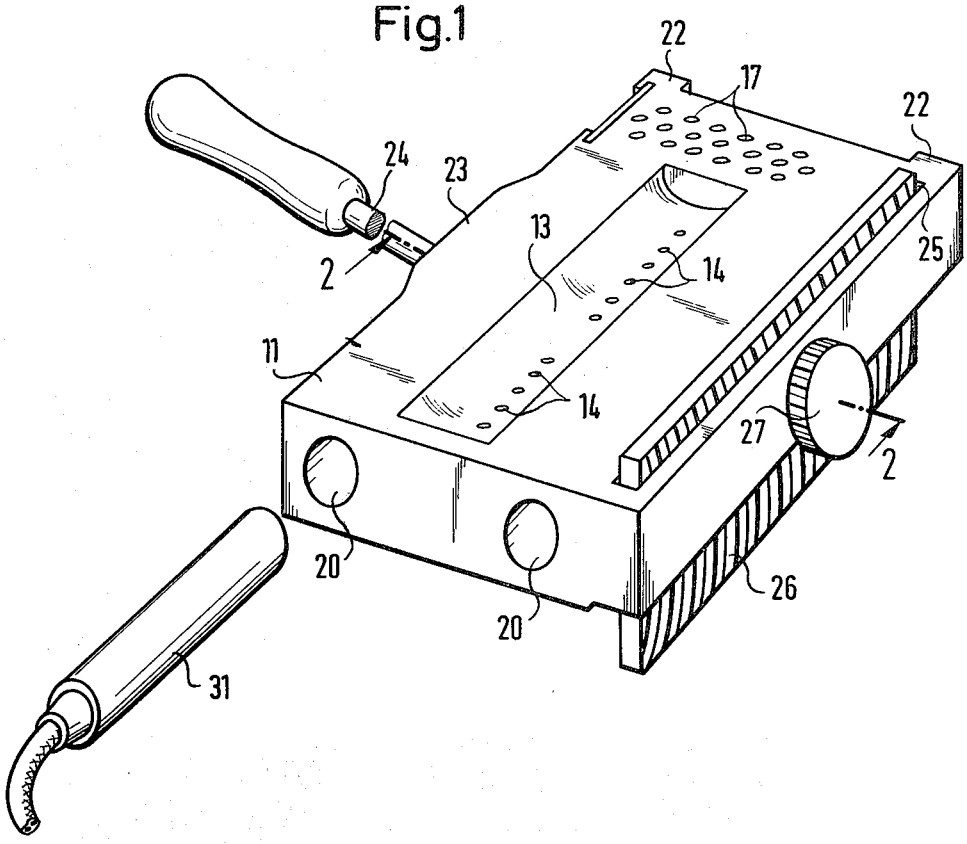
FIG. 1 shows a perspective view of a combined waxing device and edge sharpener according to the invention with an electric heating rod shown outside a flue bore.
Figure 2:
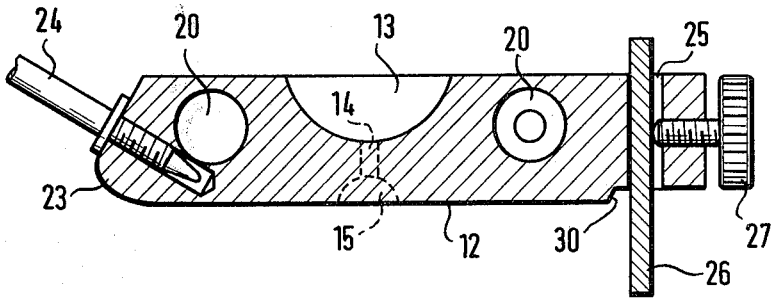
FIG. 2 shows a cut along line 2—2 of FIG. 1.
Figure 3:
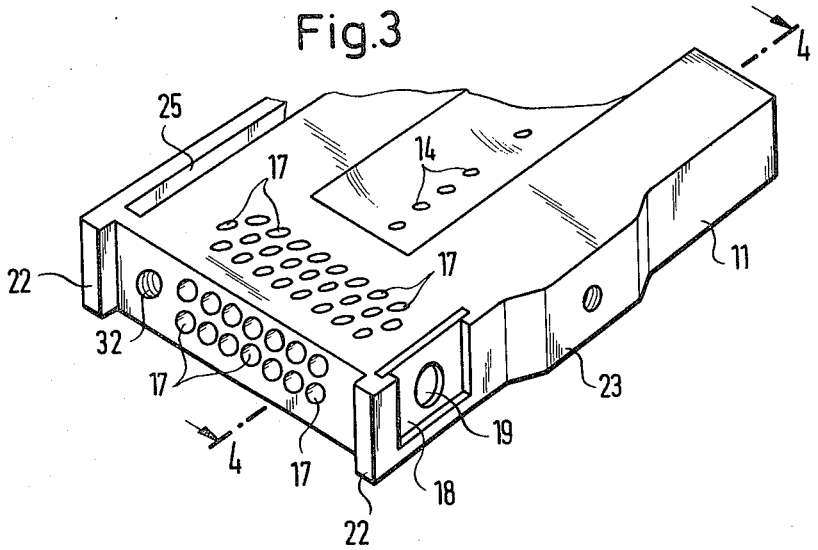
FIG. 3 shows a partially cut perspective view of the combined waxing device and edge sharpener from the side of the closeable hollow space.

The combined waxing device and edge sharpener for skiers according to the invention, shown in perspective in FIGS. 1 and 3 includes a flat rectangular body 11 which is made preferably of some good heat conducting material, for example, aluminum. The rectangular body, despite its variable shaping in detail may be cast by the die casting process and preferably has a longitudinal dimension which is slightly larger than the width of a ski. The lower main surface of the rectangular body serves, according to FIG. 2, as a guide and wax distribution surface 12. In the upper main surface there is a groove shaped indentation which serves as a wax container 13. This wax container is connected by a multiplicity of bores 14 with the guide and wax distribution surface 12, whereby these bores 14 all pass over into a hemispherical port (aperture) area 15.

Figure 4:
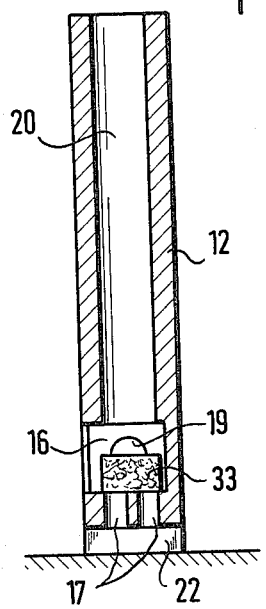
FIG. 4 shows a cut along line 4—4 of FIG. 3, from which the course of the flue bore can be recognized.
Figure 5:
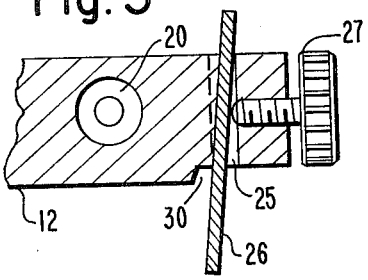
FIG. 5 shows a cross-sectional view of a portion of a further embodiment of the invention with the slit shaped recess for accommodating the file, inclined at a slight outward angle toward the guide and wax distribution surface.

Within the area of one of the front surfaces of the rectangular body 11 a closeable combustion chamber 16 has been formed, which is shown in the drawing of FIG. 4. This combustion chamber 16 is connected with the outside atmosphere by a multiplicity of air inlet openings 17 in the assigned part of the rectangular body. The combustion chamber can be closed by a slide 18 which has a hole 19 which likewise serves as an air inlet aperture and is provided at the same time also for the application of an object in order to be able to take out the slide and open the combustion chamber. The inside space of the combustion chamber is dimensioned such that a cake of dry alcohol 33 of a commercial size can be accommodated in it and there still is enough empty space available in order to ensure a perfect combustion without formation of soot. At least one flue opening 20 runs from the combustion chamber 16 in a longitudinal direction through the rectangular body and meets the free atmosphere in the opposite front side. However it was discovered that the placing of two flue openings 20 on opposite sides of the wax container 13 is particularly favorable for the heating of the waxing device, and also has a favorable influence on the course of the combustion. By limiting the volume of the combustion chamber 16 to a proper size one will prevent overheating of the waxing device on the one hand, but on the other hand the metallic rectangular body is heated sufficiently to produce the volume of heat needed for the waxing of a pair of skis.

The rectangular body, in extension of the two lateral surfaces, is provided with projections 22 on the front surface assigned to the area of the combustion chamber. The rectangular body can be set up perpendicularly on these projections 22. At the same time the lower front surface can be removed far enough from the supporting surface in order to guarantee an unimpeded entry of the air through the lower air inlet openings 17. The flue openings 20 running vertically in this position guarantee good ventilation of the combustion chamber 16.

A reinforcement 23 of the material with a threaded bore running obliquely from above into the rectangular body is provided on one of the lateral surfaces of said rectangular body 11. According to FIG. 2, this threaded bore runs preferably tangentially to the adjacent flue aperture 20 and cuts the latter slightly. A handle 24 can be screwed into the threaded bore, which handle tapers conically at its front end and in its fully screwed in state engages with the flue aperture 20. The combined waxing device and edge sharpener can be shifted with this handle 24 over the running surface of the ski for the purpose of waxing it.

On the lateral surface of the rectangular body opposite the handle 24, a slit-like recess 25 has been provided, running parallel to the lateral surface of the rectangular body, into which a metal file 26 can be inserted. This metal file can be clamped down with a clamping screw 27 which can be screwed through the assigned lateral surface, whereby the metal file — in relation to the longitudinal and transverse direction of the file — can be clamped in any random position. Thus it is possible to clamp the file again and again in such a way that still sharp teeth of the file would be in the area which is guided along the steel edge of the ski. The slit shaped recess 25 can run at an angle which is inclined only slightly toward the guide and wax distribution surface 12. As a result of that it is possible to take down the outside surface of the edge of the ski during sharpening of the edges in such a way that it slants at a slight outward angle toward the running surface of the ski, as a result of which the edge will lose its sharpness less quickly while traveling over icy areas.

The area on the lateral surface of the rectangular body, provided for the accommodation of the metal file, is somewhat displaced on the underside in relation to the guide and wax distributing surface 12, so that a break 30 develops. This preferably rounded break causes the liquid wax to detach itself during the waxing of the skis from the guide and wax distributing surface of the waxing implement and does not penetrate the slit shaped recess 25, from which the metal file 26 is removed during waxing of the ski.

In order not to have to use an open flame inside a building, provision has been made for a heating rod 31 to be inserted into one of the flue openings 20 in order to heat the rectangular body for waxing. The heating rod 31 can be jammed in the flue bore 20 with the help of the handle 24, by fitting the conically tapering point during screwing in of the handle against the outside surface of the heating rod 31 and pressing it against the wall of the flue bore. The use of an electric heating rod also has the advantage that the combined waxing device and edge sharpener can be kept at an even temperature corresponding to the melting temperature of the wax, and thus it is possible to wax a number of skis in succession, without there being any need for the insertion of waiting times for heating up the metallic, rectangular body as may become necessary in case of the use of dry alcohol, especially in case of low temperatures.

For placing the multiplicity of bores 14, which connect the wax containers 13 with the guide and wax distribution surface 12, it turned out to be effective to select the distances such that the areas of the mouth 15 developed with a diameter of about 5 mm come to lie next to each other at a slight distance. In order to avoid an unnecessarily great collection of wax in the guide groove of the ski, provision has been made to leave out one or two bores respectively in the middle area of the bores, disposed preferably adjacent to one another in a row. In the wax container 13, the mouth of the bore 14 can be cross connected by a narrow groove.

The handle 24, which can be unscrewed from the rectangular body 11, can be inserted into a flue opening 20 and screwed into it for safe keeping when it is carried along in a pocket with the combined waxing device and edge sharpener. For this purpose a threaded bore 32 is provided in the extension of the flue opening on the frontside of the rectangular body adjacent to the combustion chamber 16, into which the front end of the handle 24 can be inserted. In the area of its thread, the handle 24 is provided with a guide disc, which corresponds approximately to the diameter of the flue opening, so that the screwing in of the handle into the threaded bore 32 will cause no difficulties.

For the further explanation of the invention, a waxing process with the use of dry alcohol is now described. A commercial piece of dry alcohol 33 is inserted into the combustion chamber 16 and the latter is closed with the slide 18 for the purpose of heating the device. At the same time the quantity of dry alcohol is dimensioned such that a pair of skis can be waxed with one commercially obtainable piece. For heating of the device, the latter, as shown in FIG. 4 is stood up vertically and the dry alcohol is lighted. Sufficient fresh air enters through air inlet openings 17 into the combustion chamber, so that the dry alcohol will burn without formation of soot and the hot exhaust gasses upon flowing through the flue apertures 20 will heat the metallic rectangular body. In the case of a practical embodiment of the invention, a time of about three minutes was needed to heat up the rectangular body, whereby about two-thirds of the dry alcohol is burned. As soon as a sufficiently high temperature for the melting of the wax has been reached the device is placed with its guide and wax distributing surface 12 on the running surface of the ski, and a piece of wax is inserted into the wax container 13. This wax melts on the basis of the heat fed to the rectangular body, and flows through the bores 14 onto the running surface of the skis. The waxing device, for the purpose of waxing the ski, is now pulled evenly and slowly across the running surface of the ski, whereby the liquid wax detaches itself from the waxing implement at the break 30 with a smooth surface and solidifies on the running surface of the ski. No provision has been made for carrying out a reciprocating movement with the waxing device, because as a result of that one could hardly achieve an evenly smooth surface for the wax coating. The thickness of the wax layer can be determined by a quicker or slower pulling of the device across the running surface of the ski, whereby in case of pulling more slowly across, the layer of wax will be thicker and by pulling it across quickly the layer of wax will be thinner. As a result of the fact that in case of the combined waxing device and edge sharpener, the wax is melted within the wax container 13 and through the device reaches the running surface of the ski in about the middle area of the guide and wax distributing surface 12, it will be guaranteed that the temperature conducted via this guide and wax distributing surface 12 from the rectangular body into the wax, will ensure an even spreading of said wax. During waxing of the first ski the dry alcohol continues to burn in the combustion chamber and continuously feeds sufficient heat to the rectangular body in order to compensate for the loss of heat during melting of the wax. In case of very low temperatures, the waxing device can be set up perhaps once more after waxing of the first ski in order to heat it up once more. Whenever the dry alcohol is used up during waxing of the second ski during said waxing process, the heat capacity of the rectangular body will suffice to complete waxing this second ski.

By a suitable measurement of the mass of the rectangular body on the one hand and of the size of the combustion chamber on the other hand one will be able to wax one pair of skis with a commercial piece of dry alcohol. By limiting the combustion chamber for the use of one piece of dry alcohol any overheating of the rectangular body will also be avoided, so that the ignition temperature for the wax cannot be reached thus any danger of a combustion of the wax will be avoided.

What is claimed is:

1. A combined edge sharpener and waxing device for use with wax and heating means to wax and sharpen skis comprising:

a manually manipulable file holder carrying at least one metal file, which holder has a guide surface standing substantially perpendicularly to the cut of the metal file, and in which the metal file can be clamped in variable positions relative to the transverse direction of the file holder, the file holder defining a heatable and flat waxing implement including means forming a wax melting container, means for receiving container heating means to heat the container to wax melting temperature, means extending from the container to the guide surface through which melted wax can flow to the guide surface, said guide surface defining a wax distribution surface for evenly distributing the melted wax across the running surface of the ski when the combined device is pulled along said running surface.

2. Combined waxing device and edge sharpener as in claim 1, characterized in that the file holder is a flat metallic rectangular body with a slit shaped recess for the accommodation of the metal file, said recess running parallel to a part of a lateral surface of said holder, said means for receiving container heating means comprising a closeable combustion chamber with air inlet openings in the area of one side surface of the rectangular body, into which chamber leads at least one flue bore running in a longitudinal direction and emerging through the side surface opposite the combustion chamber, one main surface of the rectangular body is developed as a flat guide and wax distributing surface into which lead a multiplicity of bores which form at least part of said wax flow means and which run from said means forming the wax melting container, said means forming the wax melting container being formed in the opposite main surface.

3. Combined waxing device and edge sharpener as in claim 2, characterized in that two flue bores, one running on either side of the means forming the wax melting container, are provided in the rectangular body.

4. Combined waxing device and edge sharpener as in claim 2, characterized in that the mouth area of the multiplicity of bores widens generally hemispherically in the guide and wax distribution surface.

5. Combined waxing device and edge sharpener as in claim 2, characterized in that at least one of said at least one flue bore is adapted to receive an electric heating rod therein, whereby the means forming the wax melting container may be electrically heated to wax melting temperature.

6. Combined waxing device and edge sharpener as in claim 5, characterized in that the device includes means for securing a handle to the rectangular body.

7. Combined waxing device and edge sharpener as in claim 5 in combination with an electric heating rod.

8. Combined waxing device and edge sharpener as in claim 2, characterized in that the slit shaped recess for the accommodation of the metal file, is inclined at a slight outward angle toward the guide and was distribution surface.

9. A combined edge sharpener and waxing device for use with wax and heating means and metal filing means to wax and sharpen skis comprising:

a manually manipulable file holder for carrying at least one metal file, which holder has a guide surface standing substantially perpendicularly to the cut of the metal file, and in which the metal file can be clamped in variable positions relative to the transverse direction of the file holder;

the file holder defining a heatable and flat waxing implement including means forming a wax melting container, means for receiving container heating means to heat the container to wax melting temperature, means extending from the container to the guide surface through which melted wax can flow to the guide surface, said guide surface defining a wax distribution surface for evenly distributing the melted wax across the running surface of the ski when the combined device is pulled along said running surface.

10. Combined waxing device and edge sharpener as in claim 9, characterized in that the file holder is a flat metallic rectangular body with a slit shaped recess for the accommodation of the metal file, said recess running parallel to a part of a lateral surface of said holder, said means for receiving container heating means comprising a closeable combustion chamber with air inlet openings in the area of one side surface of the rectangular body, into which chamber leads at least one flue bore running in a longitudinal direction and emerging through the side surface opposite the combustion chamber, one main surface of the rectangular body is developed as a flat guide and wax distributing surface into which lead a multiplicity of bores which form at least part of said wax flow means and which run from said means forming the wax melting container, said means forming the wax melting container being formed in the opposite main surface.

11. Combined waxing device and edge sharpener as in claim 10, characterized in that two flue bores, one running on either side of the means forming the wax melting container, are provided in the rectangular body.

12. Combined waxing device and edge sharpener as in claim 10, characterized in that the mouth area of the multiplicity of bores widens generally hemispherically in the guide and wax distribution surface.

13. Combined waxing device and edge sharpener as in claim 10, characterized in that at least one of said at least one flue bore is adapted to receive an electric heating rod therein, whereby the means forming the wax melting container may be electrically heated to wax melting temperature.

14. Combined waxing device and edge sharpener as in claim 13, characterized in that the device includes means for securing a handle to the rectangular body.

15. Combined waxing device and edge sharpener as in claim 13 in combination with an electric heating rod.

16. Combined waxing device and edge sharpener as in claim 10, characterized in that the slit shaped recess for the accommodation of the metal file, is inclined at a slight outward angle toward the guide and wax distribution surface.

* * * * *